US005336045A

United States Patent [19]

Koyama et al.

[11] Patent Number: 5,336,045

[45] Date of Patent: Aug. 9, 1994

[54] FUEL PUMP

[75] Inventors: Hideki Koyama, Okazaki; Takashi Hamaoka, Kariya, all of Japan

[73] Assignee: Nippondenso Co., Ltd., Kariya, Japan

[21] Appl. No.: 6,535

[22] Filed: Jan. 21, 1993

[30] Foreign Application Priority Data

Jan. 22, 1992 [JP] Japan ..... 4-009294

[51] Int. Cl.[5] ..... F04D 29/40; F04D 5/00

[52] U.S. Cl. ..... 415/55.10; 415/55.2; 415/55.6

[58] Field of Search ..... 415/55.1, 55.2, 55.5, 415/55.6, 55.7

[56] References Cited

U.S. PATENT DOCUMENTS 2,282,569 5/1942 Fabig ..... 415/55.5
4,493,620 1/1985 Takei et al. .
4,591,311 5/1986 Matsuda et al. .
4,793,766 12/1988 Kumata ..... 415/55.1

FOREIGN PATENT DOCUMENTS 58-210394 12/1983 Japan .
79193 5/1985 Japan .
105296 5/1988 Japan .
64-25494 2/1989 Japan .
3-11191 1/1991 Japan .
1506957 4/1978 United Kingdom .
385745 1/1993 United Kingdom .

*Primary Examiner*—Edward K. Look
*Assistant Examiner*—James A. Larson
*Attorney, Agent, or Firm*—Cushman, Darby & Cushman

[57] ABSTRACT

A fuel pump includes a flow channel formed substantially along an outer periphery of an impeller. Fuel is sucked from a suction port opened to an inlet portion so as to flow from an introduction groove to a pressurizing groove. The introduction groove is formed so that a sectional lateral length of the groove gradually becomes smaller from the inlet portion toward the pressurizing groove. Further, bottom portions at the deepest portion of the introduction groove are formed to extend gradually outwardly from the suction port opened to the inlet portion. The bottom portions of the introduction groove are so formed that the depth of the introduction groove gradually becomes smaller from the suction port. With such structure, the fuel sucked from the suction port can flow smoothly so that the occurrence of the fuel vapor is restrained and the flow rate reduction of the fuel at a high temperature is prevented.

11 Claims, 6 Drawing Sheets

FUEL PUMP

BACKGROUND OF THE INVENTION

1. Industrial Field of the Invention

The present invention relates to a fuel pump and, more particularly, to a regenerative type fuel pump for pressurizing and pumping fuel.

2. Description of the Prior Art

Conventionally, a regenerative type pump for pressurizing and pumping fuel is known as a fuel supply device of an internal combustion engine for an automobile.

In a regenerative fuel pump disclosed in, for example, Japanese Patent Unexamined Publication No. 58-210394, a fuel suction port is formed to be enlarged toward a rotary shaft of an impeller, to prevent flow rate reduction of fuel at a high temperature.

In a fuel pump disclosed in Japanese Utility Model Unexamined Publication No. 64-25494, a groove for a pump channel is the deepest at its inlet portion and the depth of the groove gradually becomes smaller, so as to restrict the occurrence of fuel vapor.

The conventional fuel pump having the above structure, has tried to prevent the decrease of the fuel flow rate at the high temperature by improving the shape of the suction port of the regenerative fuel pump. However, with the shape of the suction port in the pump disclosed in Japanese Patent Unexamined Publication No. 58-210394, a measure of enlarging the inlet portion is chosen, but a satisfactory characteristic of the flow rate cannot still be obtained.

Also, with the shape as disclosed in Japanese Utility Model Unexamined Publication No. 64-25494, the inlet portion is not large enough to prevent the occurrence of the fuel vapor at the inlet portion sufficiently. Thus, the satisfactory characteristic of the flow rate cannot still be obtained.

In view of the above-described disadvantages of the prior art, the present invention aims to provide a fuel pump which can restrain flow rate reduction of fuel at a high temperature and obtain a sufficient flow rate of fuel even at the high temperature, by improving the structure of the portion extending between the suction port and the inlet portion of the regenerative fuel pump.

SUMMARY OF THE INVENTION

In order to solve the above problems, the invention adopts a technical measure of a fuel pump characterized by comprising:

a disk-like impeller to be rotatingly driven;

casing halves which receive the impeller, each having a C-shaped flow channel formed substantially along an outer periphery of the impeller; said casing halves comprising a pressurizing groove constituting a part of the flow channel, the groove having predetermined sectional lateral and vertical lengths and being formed along the outer periphery of the impeller;

an inlet portion formed at one end of the flow channel and enlarged inside of the outer periphery of the impeller so that the sectional lateral length of the channel at the inlet portion is larger than that of the pressurizing groove;

a suction port for sucking fuel, which extends in an axial direction of the impeller and is positioned inside of the outer periphery of the impeller, the suction port being opened to the inlet portion;

a discharge port in communication with the other end of the flow channel to exhaust the fuel; and an introduction groove formed between the inlet portion and the pressurizing groove, a sectional lateral length of which introduction groove gradually becomes smaller from the inlet portion toward the pressurizing groove, and a sectional vertical length of which introduction groove gradually becomes smaller from the suction port communicating with the inlet portion, toward the pressurizing groove, while the deepest portion of the introduction groove takes a course gradually shifting from the suction port toward the outer periphery of the impeller.

With the structure of the invention as mentioned above, the fuel is pressurized during rotation of the impeller in the casing before being discharged. The fuel is sucked from the suction port into the channel, and is pressurized while flowing through the channel and exhausted from the discharge port.

The fuel sucked from the suction port flows into the inlet portion at first. The fuel successively flows through the introduction groove and the pressurizing groove and it arrives at the discharge port.

The pressurizing groove is formed to have predetermined sectional lateral and vertical lengths and to extend along the outer periphery of the impeller. Herein, the sectional lateral length of the channel portion means a sectional lateral length of the channel in a radial direction of the impeller, and the sectional vertical length of the channel portion means a sectional vertical length of the channel in an axial direction of the impeller. The fuel is pressurized while flowing mainly through the pressurizing groove and is exhausted from the discharge port.

The inlet portion of the channel is enlarged inwardly of the impeller so that the sectional lateral length of the inlet portion is larger than that of the pressurizing groove. The suction port is so formed as to extend parallel to the axis of the impeller and to open inside of the outer periphery of the impeller. Accordingly, the suction port opens toward the end face of the disk-like impeller.

The introduction groove is provided between the inlet portion and the pressurizing groove for connecting them to each other, such that sectional lateral and vertical lengths of the introduction groove gradually change. More specifically, the sectional lateral length of the introduction groove gradually decreases from the inlet portion to the pressurizing groove, and the sectional vertical length of the groove which extends from the suction port communicating with the inlet portion to the pressurizing groove is gradually reduced toward the pressurizing groove. Also, the deepest portion of the introduction groove takes a course gradually shifting from the suction port toward the outer periphery of the impeller. Thus the channel becomes gradually narrow from the inlet portion toward the pressurized groove. Because the deepest portion of the introduction groove takes the course gradually shifting from the suction port toward the outer periphery of the impeller, a central portion of the channel where the fuel flows smoothly, takes a course gradually shifting from the suction port opened inside of the outer periphery of the impeller through the introduction groove toward the pressurizing groove formed along the outer periphery of the impeller.

Succeedingly, by enlarging the space of the inlet portion inwardly of the impeller, the suction port having a sufficiently large opening and the inlet portion with an enough volume can surely be obtained. Thanks to the provision of the introduction groove, the fuel sucked from the suction port opened inside of the outer periphery of the impeller smoothly flows to the outer periphery of the impeller through the introduction groove.

Therefore, according to the invention, since the fuel flows smoothly from the suction port to the pressurizing groove, the occurrence of the fuel vapor at the high temperature can be restrained and the reduction of the fuel flow rate at the high temperature can be prevented.

The fuel vapor vent hole may be provided at a location where the width and depth of the introduction groove becomes constant. With such structure, a fuel pressure at a predetermined value can be established at the fuel vapor vent hole and a preferable efficiency of exhausting the vapor can be exhibited.

Further, the invention can be applied to the primary stage pump structure of a two-stage fuel pump. The two-stage fuel pump has an advantage of a large delivery capacity, but in the two-stage fuel pump, a degree of the flow rate reduction is large at the high temperature. Under such condition, by application of the invention to the primary stage structure of the two-stage fuel pump, the decrease of the flow rate at the high temperature is lessened largely so that the large flow rate of the two-stage fuel pump can be advantageously maintained at the high temperature.

DETAILED DESCRIPTION OF THE PREFERRED EMBODIMENT

One preferred embodiment of the invention applied to a fuel pump of a gasoline internal combustion engine for an automobile, will now be described with reference to FIGS. 1 to 9.

The fuel pump of this embodiment is of an in-tank type dipped in fuel within a fuel tank of an automobile.

Figure 1:
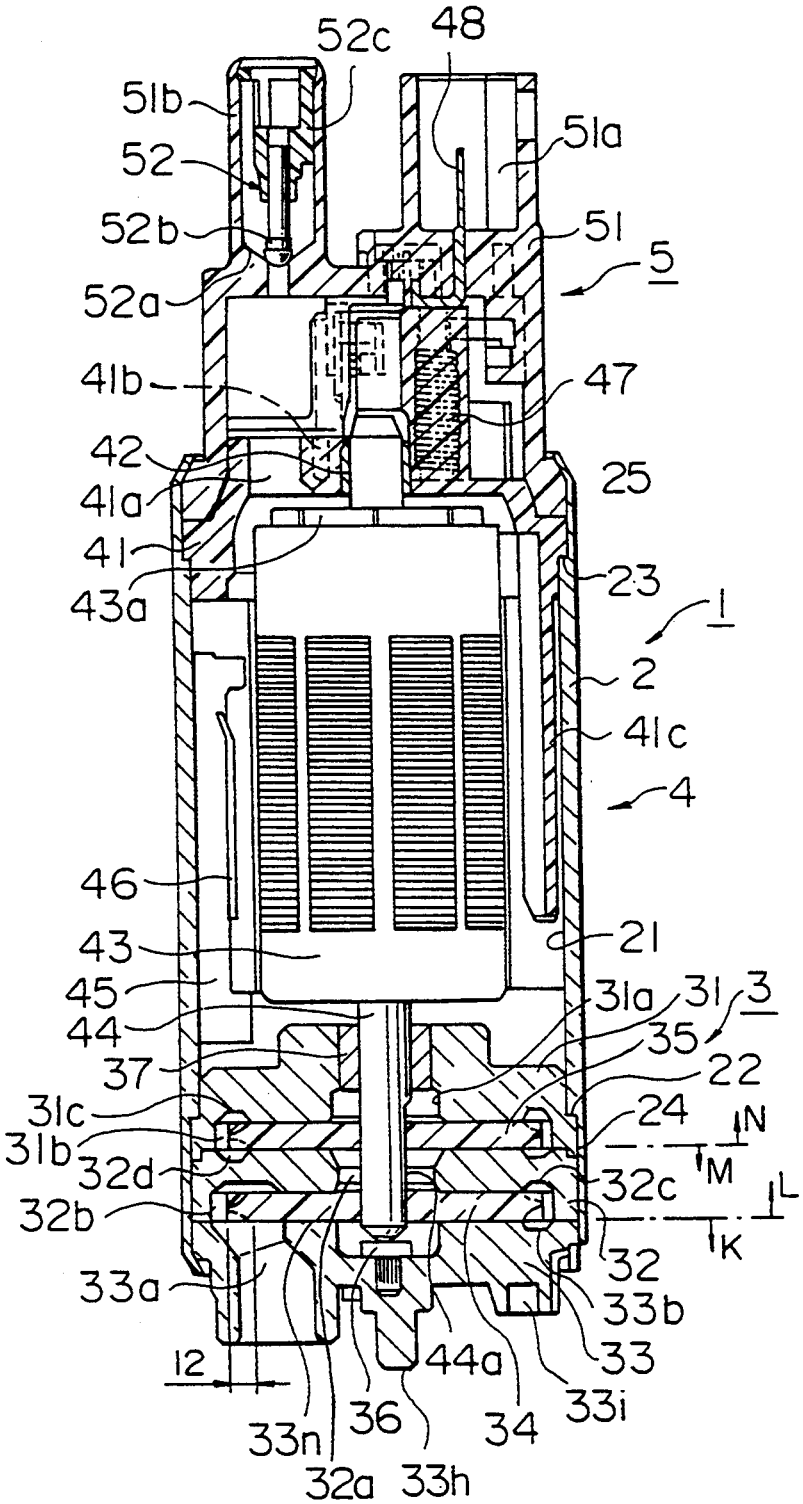
FIG. 1 is a cross-sectional view of a fuel pump to which the invention is applied.

FIG. 1 is a cross-sectional view showing a structure of the fuel pump.

A fuel pump 1 comprises a pump section 3 accommodated in a housing 2, a motor section 4 and a discharge section 5.

An inner surface of the cylindrical housing 2 is machined at both end portions to form a central cylindrical portion 21, stepped portions 22, 23 and thin-walled portions 24, 25.

The pump section 3 is accommodated in the housing 2 and located at one end portion of the housing 2. The pump section 3 includes a case 31, a spacer 32, a cover 33, a first impeller 34 and a second impeller 35. The case 31 is press-fitted in the central cylindrical portion 21 of the housing 2, and the spacer 32 and the cover 33 are in turn received in the thin-walled portion 24 of the housing 2. Subsequently, the thin-walled portion 24 of the housing 2 is deformed for caulking to secure the pump section 3 in the housing 2.

The first impeller 34 is received between the cover 33 and the spacer 32 to constitute a primary-stage pump. The second impeller 35 is received between the spacer 32 and the case 31 to thereby constitute a secondary-stage pump.

The cover 33 is provided with a fuel suction port **33*a*, and formed with a C-shaped flow channel 33*b* on the surface opposite to the spacer 32, the flow channel 33*b* extending substantially along an outer periphery of the first impeller 34. The cover 33 is molded to have the fuel suction port 33*a* in a cylindrical shape, and the suction port 33*a* is then finished by drilling the inner surface. A thrust bearing 36 is press-fitted in the cover 33 to support a shaft 44** of a motor which will be described below.

Figure 2:
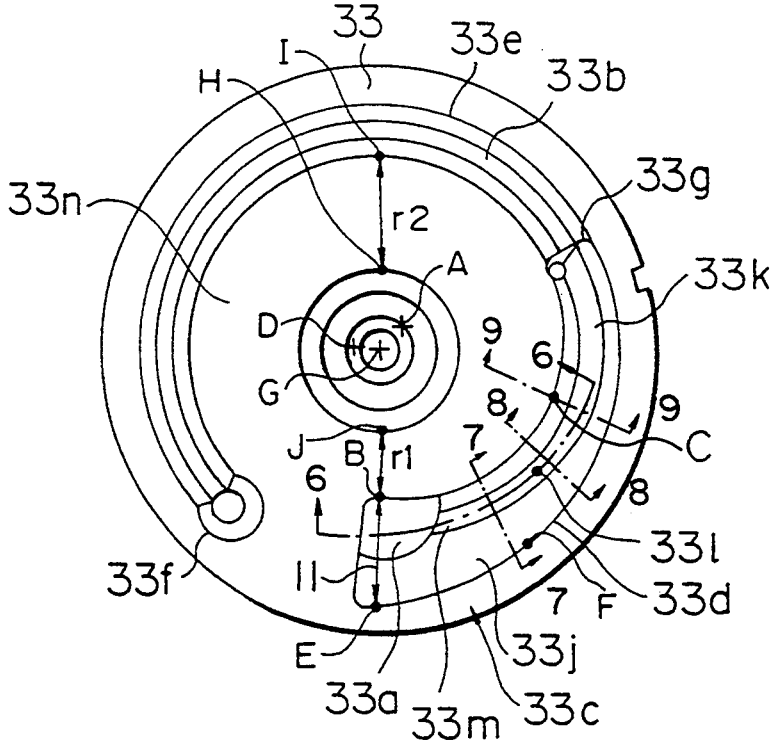
FIG. 2 is a top plan view of a cover 33, as viewed along a direction of an arrow K of FIG. 1.

FIG. 2 is a top plan view of the cover 33, as viewed along a direction of an arrow K in FIG. 1. The flow channel **33*b* comprises an inlet portion 33*c* in communication with the suction port 33*a*, an introduction groove 33*d* which gradually becomes smaller in width and depth from the inlet portion 33*c*, and a pressurizing groove 33*e* formed to extend from the introduction groove 33*d* to a terminal end portion 33*f*. The suction port 33*a* extends along an axial direction of the impeller 34 and opens to the inlet portion 33*c* which is provided inside of the outer periphery of the impeller 34. A fuel vapor vent hole 33*g* extending through the cover 33 is formed on a terminal inner side of the introduction groove 33*d***.

Referring to FIG. 2, the inner side edge of the introduction groove **33*d* between a point B and a point C forms a circular arc around a center of a point A. The outer side edge of the introduction groove 33*d* between a point E and a point F forms a circular arc around a center of a point D of FIG. 2. As a result, the inner side edge of the introduction groove 33*d* extends gradually outwardly along a direction of rotation of the impeller 34, while the-outer side edge of the introduction groove 33*d* extends gradually inwardly in the rotating direction of the impeller. Accordingly, a sectional lateral length of the introduction groove 33*d* gradually decreases from the inlet portion 33*c* toward the pressurizing groove 33*e*. A sectional lateral length 11 of the groove 33*d* at the inlet portion 33*c* (a distance between the points B and E in FIG. 2) is 7.13 mm. The inner and outer side edges of the introduction groove 33*d* except between the points B and C and between the points E and F form concentric circular arcs around a central point G of the cover 33. The inner and outer side edges of the introduction groove 33***d* in the above region extend along the outer periphery of the impeller 34.

A seal surface 33*n* of the cover 33 opposite to the impeller 34 is slightly separated from the impeller 34 with a minute clearance between them, which seal surface 33*n* prevents fuel pressure leakage. In this embodiment, a seal width of the most narrow portion r1 (between the points B and J in FIG. 2) of the seal surface 33*n* at the inlet portion 33*c* is predetermined at 4.6 mm, and a seal width of the widest portion r2 (between points H and I in FIG. 2) of the seal surface 33*n* at the pressurizing groove 33*e* is predetermined at 7.25 mm.

Figure 6:
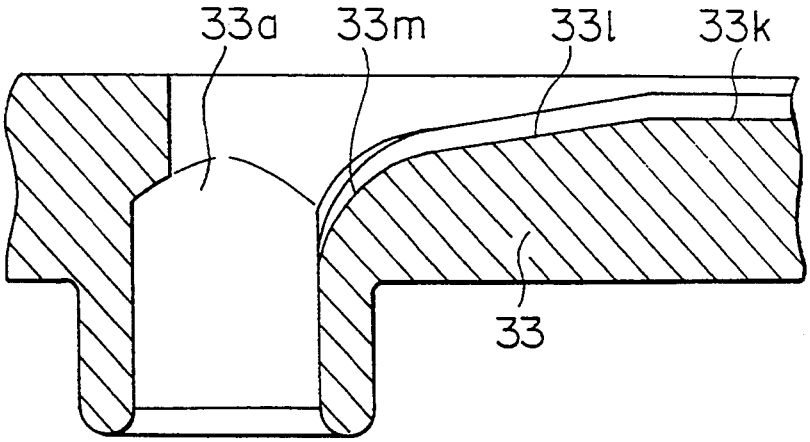
FIG. 6 is a developed view showing a cross-section of the cover 33, taken along a line 6—6 of FIG. 2.

FIG. 6 is a partially cross-sectional view of the cover 33, taken along a line 6—6 of FIG. 2 and developed into a plane view. A bottom surface of the introduction groove 33*d* includes a downstream bottom portion 33*k*, a slant bottom portion 33*l* whose depth gradually increases toward the suction port 33*a* and a curved bottom portion 33*m* which smoothly connects a vertical wall surface of the suction port 33*a* and the slant bottom portion 33*l* to each other. A stepped portion where the depth of the introduction groove 33*d* suddenly changes is formed between the downstream bottom portion 33*k* of the introduction groove 33*d* and the pressurizing groove 33*e*. A sectional lateral length of the downstream bottom portion 33*k* of the introduction groove 33*d* is predetermined to be slightly larger than that of the pressurizing groove 33*e*. That is to say, the inner side edge of the downstream bottom portion 33*k* is located on the slightly inner position of the cover as compared with the inner side edge of the pressurizing groove 33*e*. The inner side edges of the downstream bottom portion 33*k* and the pressurizing groove 33*e* are connected to each other on the inner side of the fuel vapor vent hole 33*g*, where a stepped portion extending in the radial direction is formed. In this embodiment, the curved bottom portion 33*m* is formed in a circular arc of which radius is 5 mm.

Figure 7:
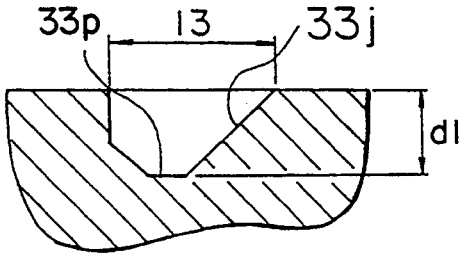
FIG. 7 is a partially cross-sectional view of the cover 33, taken along a line 7—7 of FIG. 2.
Figure 8:
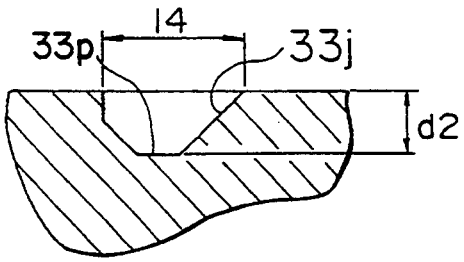
FIG. 8 is a partially cross-sectional view of the cover 33, taken along a line 8—8 of FIG. 2.
Figure 9:
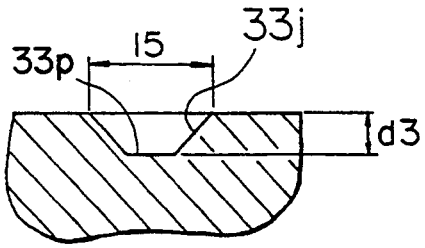
FIG. 9 is a partially cross-sectional view of the cover 33, taken along a line 9—9 of FIG. 2.

FIGS. 7, 8 and 9 are cross-sectional views, taken along lines 7—7, 8—8 and 9—9 of FIG. 2, respectively. The bottom surface 33*p* of the introduction groove 33*d* is located inside of the longitudinal central line of the groove 33*d*, extending along the inner side edge of the introduction groove 33*d*. A smoothly inclined surface 33*j* leading from the vertical wall surface of the suction port 33*a* extends outwardly of the bottom surface 33*m* of the introduction groove 33*d*. Accordingly, the deepest portion of the introduction groove 33*d* is located inside of the outer periphery of the impeller 34 so as to correspond to the suction port 33*a*, in the vicinity of the suction port 33*a* opened to the inlet portion 33*c*. The deepest portion of the introduction groove 33*d* takes a course gradually shifting toward the outer periphery of the impeller 34 in the rotating direction of the impeller, and it communicates with the pressurizing groove 33*e* extending along the rotating direction of the impeller 34. A lateral length 13 of the cross-section of the groove 33*d* taken along the line 7—7 is 5.12 mm, and a vertical length d1 thereof is 2.64 mm. A lateral length 14 of the cross-section of the groove 33*d* taken along the line 8—8 is 4.38 mm, and a vertical length d2 thereof is 1.89 mm. A lateral length of the cross-section of the groove 33*d* taken along the line 9—9 is 3.68 mm, and a vertical length d3 thereof is 1.23 mm.

The cover 33 is provided on its outer side with a projection 33*h* for fixture of a fuel filter to be attached to the suction port 33*a*, and a vapor passage 33*i* to which the fuel vapor vent hole 33*g* is opened.

The spacer 32 includes a hole 32*a* formed at its central portion, through which hole the shaft 44 extends. The spacer 32 also includes a recessed portion 32*b* on the surface opposite to the cover 33 for reception of the first impeller 34. A flow channel 32*c* of the primary-stage pump is provided on a bottom surface of the recessed portion of the spacer 32, and another flow channel 32*d* of the secondary-stage pump is formed on the surface of the spacer 32 in opposition to the case 31.

Figure 3:
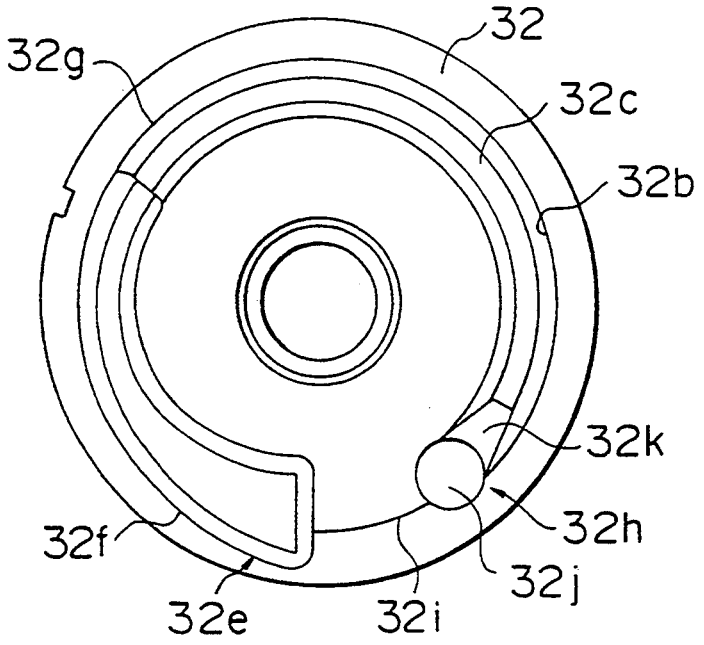
FIG. 3 is a top plan view of a spacer 32, as viewed along a direction of an arrow L of FIG. 1.

FIG. 3 is a top plan view of the spacer 32, as viewed in a direction of an arrow L of FIG. 1. A configuration of the flow channel 32*c* substantially corresponds to that of the flow channel 33*b* formed on the cover 33. The flow channel 32*c* comprises an inlet portion 32*e*, an introduction groove 32*f* which is gradually reduced in depth from the inlet portion 32*e*, and a pressurizing groove 32*g* extending from the introduction groove 32*f* to a terminal end portion 32*h*. A stepped portion is provided between the introduction groove 32*f* and the pressurizing groove 32*g*, where the depth of the flow channel 32*c* changes largely. There is provided a separating part 32*i* between the inlet portion 32*e* and the terminal end portion 32*h*.

The spacer 32 includes a communication passage 32*j* formed at the terminal end portion 32*h*, the communication passage 32*j* penetrating the spacer 32 to communicate with the secondary-stage pump, for the purpose of supplying fuel pressurized by the primary-stage pump to the secondary-stage pump. There is provided at the terminal end portion 32*h* an inclined surface 32*k* extending from the pressurizing groove 32*g* to the communication passage 32*j* so that the flow channel becomes deeper, which inclined surface 32*k* enables the fuel to flow smoothly.

Figure 4:
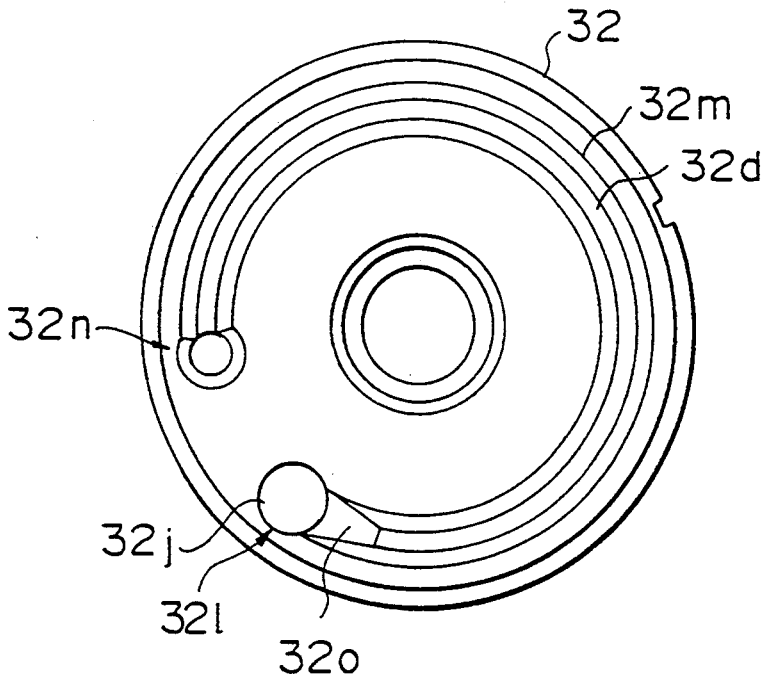
FIG. 4 is a top plan view of the spacer 32, as viewed along a direction of an arrow M of FIG. 1.

FIG. 4 is a top plan view of the spacer 32, as viewed in a direction of an arrow M of FIG. 1. The flow channel 32*d* for the secondary-stage pump formed in the spacer 32 includes a pressurizing groove 32*m* with a uniform width and depth, the pressurizing groove 32*m* extending to a terminal end portion 32*n* from an inlet portion 32*l* to which the communication passage 32*j* is opened. The inlet portion 32*l* is provided with an inclined surface 32*o* which gradually reduces the depth of the pressurizing groove 32*m* from the communication passage 32*j*, thereby allowing the fuel to flow smoothly.

The case 31 is formed at its center with a hole 31*a* through which the shaft 44 extends. A bearing 37 which rotatably supports the shaft 44 is press-fitted in the hole 31*a*. The case 31 is also formed on the surface opposite to the spacer 32 with a recessed portion 31*b* for reception of the second impeller 35. The recessed portion 31*b* is further provided on a bottom surface thereof with a flow channel 31*c* for the secondary-stage pump.

Figure 5:
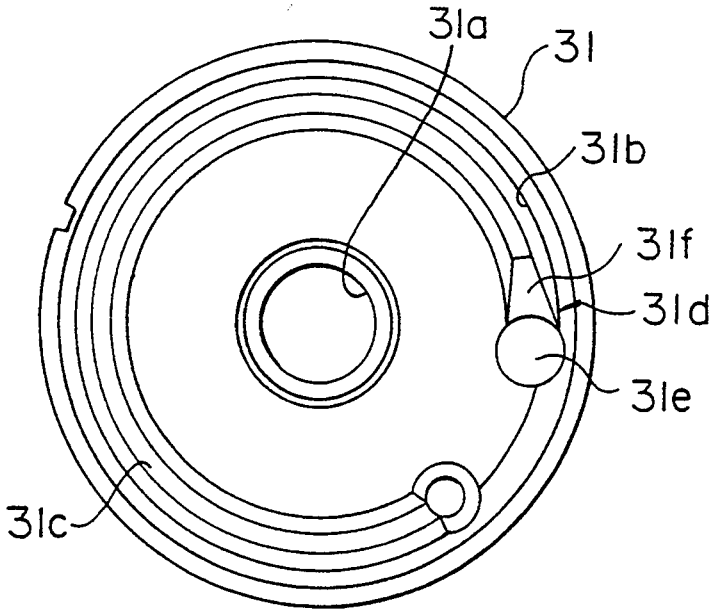
FIG. 5 is a top plan view of a case 31, as viewed along a direction of an arrow N of FIG. 1.

FIG. 5 is a top plan view of the case 31, as viewed in a direction of an arrow N of FIG. 1. The flow channel 31*c* is so formed as to correspond to the flow channel 32*d* in the spacer 32. The flow channel 31*c* is provided at its terminal end portion 31*d* with a communication hole 31*e* which penetrates the case 31 and opens to the inside of the housing 2, for discharging the fuel pressurized by the secondary-stage pump. The terminal end portion 31*d* is provided with an inclined surface 31*f* which increases the depth of a pressurizing groove 31*c* toward the communication hole 31*e*, thereby flowing the fuel smoothly.

The first impeller 34 and the second impeller 35 are formed in the same shapes having diameters of substantially 30 mm. The shape of each impeller is disk-like.

The impeller has a D-shaped hole at its center, a straight portion of which hole corresponds to a flat portion 44*a* of the shaft 44. A plurality of vane grooves are alternately formed on both surfaces of the impellers 34 and 35, respectively, at the corner portions on the outer peripheries of the both surfaces of the impellers. A length 12 of each vane groove in the impellers 34 and 35 is 2.4 mm.

The motor section 4 is located within the housing 2. A bearing holder 41 is press-fitted in the central cylindrical portion 21 of the housing 2 from an end of the housing 2 opposite to the pump section 3. The bearing holder 41 is provided with a fuel passage hole 41*a* and a central hole 41*b* in which a bearing 42 rotatably supporting the shaft 44 is press-fitted. The bearing holder 41 includes holes for retaining two brushes (not shown) and holes for retaining two noise-proof choke coils 47. The bearing holder 41 supports an electrical conductive member such as a terminal 48 for supplying power to the motor section 4. The bearing holder 41 is also provided with a tongue portion 41*c* extending inwardly along an inner wall of the housing 2.

An armature 43 is provided on the shaft 44, and is rotatably supported by means of the bearings 37 and 42. The armature 43 is formed with a plane commutator 43*a* which is supplied with electric current from the brushes supported by the bearing holder 41. The shaft 44 includes the flat portion 44*a* for rotating the impellers 34 and 35.

A magnet 45 is provided in the central cylindrical portion 21 of the housing 2. The magnet 45 is held between a leaf spring 46 and the tongue portion 41*c* extending from the bearing holder 41.

Further, a frame end 51 is press-fitted in the housing 2, to thereby constitute the discharge section 5. The bearing holder 41 and the frame end 51 are fixedly connected to the housing 2 by caulking the thin-walled portion 25 of the housing 2.

The frame end 51 is provided with a connector 51*a* for a power source of the motor section 4 and a discharge port 51*b*. A check valve 52 is accommodated within the discharge port 51*b*. The check valve 52 comprises a seat portion 52*a*, a valve body 52*b* and a holder 52*c* which are provided in a cylindrical body of the discharge port 51*b*. The holder 52*c* supports the valve body 52*b* within the cylindrical body of the exhaust hole 51*b*. The check valve 52 acts to prevent the fuel counter flow when the pump is stopped.

An operation of the fuel pump having the above-described structure, will now be described.

The fuel pump according to the embodiment of the invention is installed in a fuel tank of an automobile. A fuel filter is provided in the suction port 33*a*, while a fuel conduit is connected to the discharge port 51*b*. When the electric current is supplied from the connector 51*a*, the armature 43 for a DC motor operates so that the shaft 44 is rotated. With the rotation of the shaft 44, the two impellers 34 and 35 rotates. The primary-stage impeller 34 forms the primary-stage pump, thereby sucking the fuel through the suction port 33*a*. By rotation of the impeller 34, the fuel flows through the fuel passage formed by the flow channel 33*b* and the flow channel 32*c*, and pressurized to be discharged into the communication passage 32*j*.

At this time, bubble and vapor are discharged into the fuel tank from the fuel vapor vent hole 33*g* through the vapor passage 33*i*.

The impeller 35 forms the secondary-stage pump, for sucking the fuel from the communication passage 32*j*. By rotation of the impeller 35, the fuel flows through the fuel passage formed by the flow channel 32*d* and the flow channel 31*c*, and it is pressurized to be discharged into the housing 2.

The fuel discharged in the housing 2 flows around the armature 43, and is discharged from the discharge port 51*b* through the fuel passage hole 41*a* formed in the bearing holder 41.

The fuel discharged from the discharge port 51*b* passes through the fuel conduit (not shown) so as to be supplied to a fuel injection device of an internal combustion engine. The pressure of the fuel is controlled at a predetermined value by a fuel pressure regulator (not shown), prior to being injected into an intake manifold from a fuel injection valve.

Figure 10:
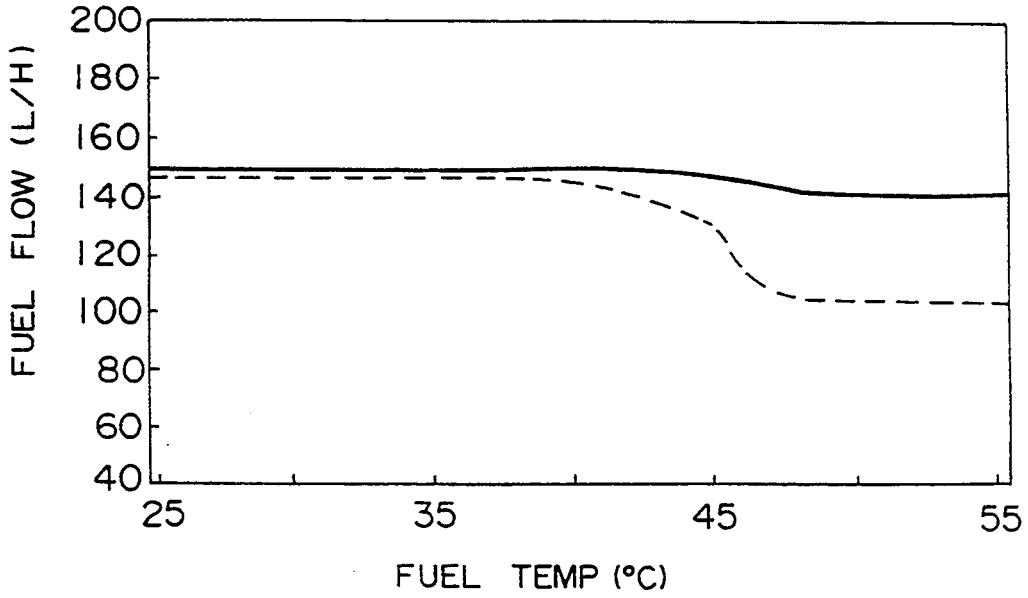
FIG. 10 is a graph showing characteristics of a flow rate of the embodiment according to the invention and a comparative example.

FIG. 10 is a graph showing a change of a fuel discharging rate when the above-described fuel pump is driven during supplying the fuel and the temperature of the fuel is raised. In this embodiment, as illustrated by the solid line in the graph, the discharging rate is hardly reduced even when the fuel temperature exceeds 45° C., and a desired high discharging rate can be maintained. However, in case of a comparative example of a fuel pump including a fuel channel for a primary-stage pump having a shape shown in FIGS. 11 and 12, the fuel discharging rate is largely reduced when the fuel temperature exceeds 45° C., as illustrated by the dotted line.

Figure 11:
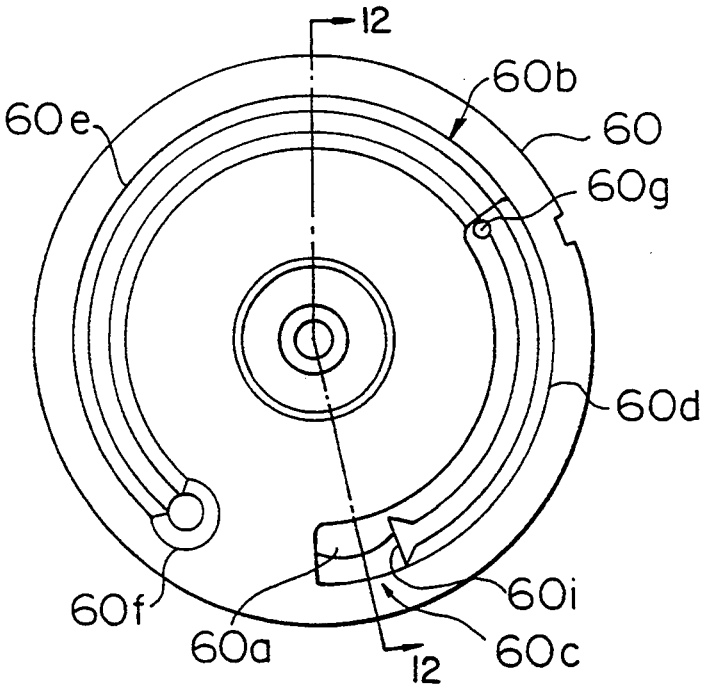
FIG. 11 (PRIOR ART)
FIG. 11 is a top plan view illustrating a cover of a conventionally comparative example.
Figure 12:
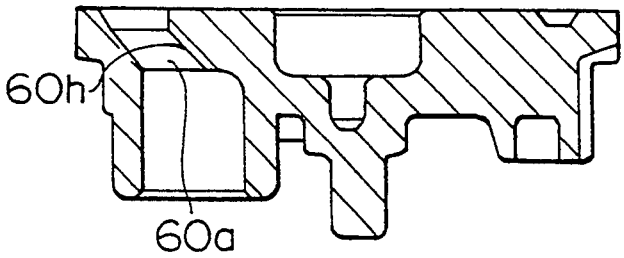
FIG. 12 (PRIOR ART)
FIG. 12 is a vertical cross-sectional view of the cover, taken along a line 12—12 of FIG. 11.

In this comparative example, the flow channel for the primary-stage pump in the above embodiment has the shape shown in FIGS. 11 and 12. FIG. 11 is a top plan view showing a cover of the fuel pump of the comparative example, and FIG. 12 is a cross-sectional view, taken along a line 12—12 of FIG. 11. In the comparative example, a spacer is provided with a flow channel having a configuration corresponding to that of FIG. 11. A flow channel 60*b* formed in a cover 60 comprises an inlet portion 60*c* in communication with an suction port 60*a*, an introduction groove 60*d* extending from the inlet portion 60*c* over a predetermined length, and a pressurizing groove 60*e* extending from the introduction groove 60*d* to a terminal end portion 60*f*. A stepped portion where the depth of the flow channel abruptly changes is provided between the introduction groove 60*d* and the pressurizing groove 60*e*. The pressurizing groove 60*d* includes a fuel vapor vent hole 60*g* formed at the terminal end on the inner side thereof, the fuel vapor vent hole extending through the cover 60. A distance from the center of the cover 60 to the inner side edge of the introduction groove 60*d* is shorter than a distance from the center of the cover 60 to the inner side edge of the pressurizing groove 60*e*, so that the width of the introduction groove 60*d* is slightly larger than that of the pressurizing groove 60*e*. The stepped portion is radially formed at a position where the fuel vapor vent hole 60*g* is provided. In the comparative example, the pump channel is so formed as to extend from the inlet portion 60*c* to the terminal end portion 60*f* along the outer periphery of the impeller. The flow of the fuel introduced from the suction port 60*a* is turned in the radial direction along an inclined surface 60*h* before it flows into the inlet portion 60*c*. The fuel flow is further turned toward the direction of rotation of the impeller by a corner portion 60*i*. Consequently, it is inferred that, in the pump channel of this comparative example, the fuel vaporization is liable to occur especially when the fuel temperature is high, because the pressure loss of the fuel is large at the inlet portion 60c, so that the flow rate is decreased as illustrated in FIG. 10.

In contrast with such comparative example, according to the invention, the favorable characteristic of the flow rate can be obtained as shown in FIG. 10, by improving the flowing condition of the fuel at the inlet portion of the pump channel.

In the embodiment, the shape of the pump channel of the primary-stage pump formed by the cover 33, the spacer 32 and the impeller 34 is desirably modified. More specifically, in the pump channel of the primary-stage pump, the occurrence of the vapor is suppressed by ensuring at the inlet portion a large enough space extends from the suction port 33a. Because the channel at the inlet portion is enlarged inside of the outer periphery of the impeller 34, the fuel can be fed smoothly into the pump channel formed in the cylindrical housing 2 through the suction port 33a formed at the end portion of the housing. At the introduction groove, the depth of the flow channel gradually becomes smaller from the inlet portion for the purpose of smoothly introducing the fuel from the inlet portion. By the facts that the inlet portion is enlarged inside of the outer periphery of the impeller 34, and that the deepest portion of the pump channel takes the course gradually shifting from the inner peripheral side of the impeller 34 to the outer peripheral side thereof so as to reach the pressurizing groove, the fuel can flow smoothly from the inner peripheral side of the impeller 34 toward the outer peripheral side thereof when it flows from the inlet portion toward the pressurizing groove. Therefore, the occurrence of the vapor can be restrained.

In the experiments carried out by the inventors, a satisfactory flow rate characteristic could not be obtained in the comparative example only by designing the depth of the flow channel to be the largest at the inlet portion and then to be reduced gradually. Also, only in the case where the flow channel in the comparative example took the course gradually shifting from the inner peripheral side of the impeller 34 to the outer peripheral side thereof with its depth unchanged, the satisfactory flow rate characteristic could not be obtained. Taking these experimental results into consideration, in the embodiment of the invention, the inlet portion is extended inwardly of the outer periphery of the impeller, and the introduction groove in communication with the inlet portion is formed into the shape such that the deepest portion thereof takes a course shifting from the inner peripheral side of the impeller to the outer peripheral side thereof. Further, the inlet portion and the introduction groove are smoothly connected to each other. For the above-mentioned reasons, the fuel pump of this embodiment according to the invention can exhibit the favorable flow rate characteristic, as shown in FIG. 10.

Since the width and depth of the introduction groove is varied until the fuel vapor vent hole, the fuel pressure at an appropriate value can be obtained there so that the vapor can be exhausted effectively.

Further, in the above embodiment, the flow rate characteristic as illustrated in FIG. 10 is obtained, by setting the size of the pump channel as follows.

In the embodiment described above, the minimum seal width r1 at the primary-stage pump is set at 4.6 mm, and the maximum seal width r2 is set at 7.25 mm; the minimum seal width r1 amounts to 63% of the maximum seal width r2. Moreover, the sectional lateral length 11 of the introduction groove 33d at the inlet portion 33c is set at 7.13 mm, and the length 12 of the vane groove in the impeller is set at 2.4 mm; the sectional lateral length 11 is set to be 2.94 times larger than the length 12 of the vane groove.

Accordingly, the inlet portion for the pump channel of the primary-stage pump is enlarged with the sealing ability of the seal surface maintained, so that the occurrence of the fuel vapor can be restrained and the flow rate of the fuel at a high temperature can be prevented from being decreased.

Additionally, it is preferable that the minimum seal width r1 amount to 30% or more of the maximum seal width r2 so as to ensure an adequate sealing characteristics. With the structure in which the pump section 3 is accommodated in the cylindrical housing 2, as in the embodiment, it is difficult to enlarge the inlet portion of the pump channel toward the outer peripheral side of the impeller. As a result, when the minimum seal width r1 is enlarged, the inlet portion is naturally reduced in size, which results in a reduction of the fuel flow rate at the high temperature. Therefore, it is desirable that the minimum seal width r1 be below 80% or less of the maximum seal width r2.

It is favorable to increase the sectional lateral length 11 of the groove 33d at the inlet portion in order to receive a sufficient amount of fuel. In this embodiment, however, since the inlet portion cannot be enlarged outwardly, the seal width is decreased if the sectional lateral length 11 is increased. Thus, in such structure as in the embodiment, it is preferable that the sectional lateral length 11 be 5 times or less than the vane groove length 12 of the impeller 34. At the same time, it is preferable that the sectional lateral length 11 at the inlet portion be 2 times or more than the vane groove length 12, for the purpose of receiving a sufficient amount of fuel to thereby decrease the pressure loss caused when the fuel passes through the suction port 33a and to thereby restrain the occurrence of the vapor.

It is desirable to increase an area of the suction port 33a which opens toward the inlet portion 33c. However, if the suction port 33a is enlarged along the rotating direction of the impeller, the channel which does not substantially have a pressurizing function, is elongated, and it is accordingly undesirable to enlarge the suction port 33a along the rotating direction of the impeller. Under such condition, as in the above embodiment, it is preferable that a larger amount of fuel can be unresistedly introduced from the suction port 33a, by increasing the sectional lateral length of the groove 11 at the inlet portion 33c.

Further, in the embodiment, the bottom surface of the introduction groove 33d is formed by the slant bottom portion 33l and the curved bottom portion 33m smoothly extending from the suction port 33a, so that the fuel flowing through the suction port 33a is smoothly introduced from the inlet portion 33c toward the introduction groove 33d along the rotating direction of the impeller 34, thereby preventing the occurrence of the fuel vapor. Concurrently, the occurrence of the fuel vapor especially at the high temperature can be restrained, and the decrease of the flow rate at the high temperature can be prevented. Favorably, a circularly curved surface whose radius is 2 mm or more, or a curved surface having a smoothness corresponding to the former surface is utilized as the curved surface extending from the suction port 33a.

Moreover, in the above-described embodiment, the pump channel is comprised of the plurality of surfaces as a matter of convenience of machining operations, whereas the pump channel may be wholly formed from a single smoothly-curved surface. In the embodiment, although the invention is applied to the two-stage fuel pump, it may be a single-stage or multi-stage fuel pump.

Owing to the structure and function of the invention as mentioned above, the fuel smoothly flows from the suction port to the pressurizing groove. Therefore, the fuel vapor at the high temperature can be restrained from occurrence and the flow rate of the fuel at the high temperature can be prevented from being decreased.

What is claimed is:

1. A fuel pump comprising:

a disk-like impeller to be rotatingly driven;

casing halves which receive said impeller, each casing half having a C-shaped flow channel formed substantially along an outer periphery of said impeller;

each casing half comprising a pressurizing groove constituting a part of said flow channel, said groove having a predetermined sectional lateral length and being formed along the outer periphery of said impeller;

an inlet portion formed at one end of said flow channel and enlarged inside of the outer periphery of said impeller so that the sectional lateral length of the channel at the inlet portion is larger than that of said pressurizing groove, said inlet portion having an inner wall which gradually extends toward the outer periphery of the impeller in a direction of rotation of the impeller;

a suction port for sucking fuel, which extends in an axial direction of said impeller and is positioned inside of the outer periphery of said impeller, said suction port being opened to said inlet portion and merging smoothly therewith for preventing loss of pressure which causes vapor in the fuel;

a discharge port communicating with the other end of said flow channel to discharge the fuel; and an introduction groove formed between said inlet portion and said pressurizing groove, a sectional lateral length of said introduction groove gradually becoming smaller from said inlet portion toward said pressurizing groove, and a sectional vertical length of said introduction groove gradually becoming smaller from said inlet portion toward said pressurizing groove, while a deepest portion of the introduction groove takes a course gradually shifting from the exit of said suction port toward the outer periphery of said impeller.

2. A fuel pump comprising:

a disk-like impeller to be rotatingly driven;

casing halves which receive said impeller, each casing half having a C-shaped flow channel formed substantially along an outer periphery of said impeller;

each casing half comprising a pressurizing groove constituting a part of said flow channel, said groove having a predetermined sectional lateral length and being formed along the outer periphery of said impeller;

an inlet portion formed at one end of said flow channel and enlarged inside of the outer periphery of said impeller so that the sectional lateral length of the channel at the inlet portion is larger than that of said pressurizing groove;

a suction port for sucking fuel, which extends in an axial direction of said impeller and is positioned inside of the outer periphery of said impeller, said suction port being opened to said inlet portion;

a discharge port communicating with the other end of said flow channel to discharge the fuel; and an introduction groove formed between said inlet portion and said pressurizing groove, a sectional lateral length of said introduction groove gradually becoming smaller from said inlet portion toward said pressurizing groove, and a sectional vertical length of said introduction groove gradually becoming smaller from said inlet portion toward said pressurizing groove, while a deepest portion of the introduction groove takes a course gradually shifting from the exit of said suction port toward the outer periphery of said impeller, wherein said pressurizing groove is formed concentrically with the outer periphery of said impeller, an inner side edge of said introduction groove extends gradually outwardly from said inlet portion to lead to an inner side edge of said pressurizing groove, and the deepest portion of said introduction groove takes a course gradually shifting from the exit of said suction port toward the outer periphery of said impeller.

3. A fuel pump according to claim 2, wherein an inclined surface is formed between the inner side edge of said introduction groove and the deepest portion thereof, while another inclined surface is formed between the outer side edge of said introduction groove and the deepest portion thereof, and the outer side inclined surface is wider than the inner side inclined surface.

4. A fuel pump according to claim 3, wherein the outer side edge of said introduction groove takes a course gradually shifting inwardly from said inlet portion toward the outer side edge of said pressurizing groove.

5. A fuel pump according to claim 2, wherein the deepest portion of said introduction groove includes a downstream bottom portion which is formed most adjacently to said pressurizing groove, a slant bottom portion which gradually becomes deeper from said downstream bottom portion toward said suction port and a curved bottom portion which smoothly connects a vertical wall face of said suction port and said slant bottom portion.

6. A fuel pump according to claim 2, wherein a seal surface for sealing to prevent fuel pressure leakage, extends on a surface of one of said casing halves inside of said introduction groove and said pressurizing groove, with a clearance between said seal surface and said impeller, and a width of the seal surface at said inlet portion amounts to about 30% or more of the maximum width of the seal surface at said pressurizing groove.

7. A fuel pump according to claim 2, wherein a fuel vapor vent hole is provided on the downstream side of said introduction groove.

8. A fuel pump according to claim 2, wherein at least one of said casing halves is accommodated in a cylindrical housing and is located generally at one end of the housing.

9. A fuel pump according to claim 8, wherein said suction port is opened at one end of said flow channel in said at lease one casing half.

10. A fuel pump according to claim 2, wherein said fuel pump is a two-stage pump, said casing halves constituting a primary stage of the pump, and said discharge port is a communication hole for a second stage of the pump.

11. A fuel pump comprising:

an electric motor;

a disk-like impeller adapted to be driven by said motor;

a casing containing said impeller therein and having a suction port for sucking fuel at a position inside of an outer periphery of said impeller, an introduction groove connected with said suction port and formed arcuately along the outer periphery of said impeller, a pressurizing groove connected to said introduction groove and formed arcuately along the outer periphery of said impeller, and a discharge port connected to said pressurizing groove for discharging pressurized fuel therefrom;

said introduction groove having a lateral width which is gradually reduced in a direction of rotation of said impeller and a depth which varies laterally and is gradually reduced in a direction of rotation of said impeller, an inner side wall of said introduction groove being defined by a first arc, of which a center is shifted from a center of said impeller such that said inner side wall is directed to the outside of said impeller from said suction port toward said pressurizing groove, an outer side wall of said introduction groove being defined by a second arc, of which a center is shifted from the center of said impeller such that said outer side wall is directed to the inside periphery of said impeller from said suction port toward said pressurizing groove, and said introduction groove being connected to said suction port continuously and having a bottom depth which is directed to the outside periphery of said impeller from said suction port; and said pressurizing groove being substantially constant in lateral width and depth, inner and outer side walls of said pressurizing groove being defined by third and fourth arcs which have centers thereof corresponding to the center of said impeller.

* * * * *